US006082644A

United States Patent [19]

Turner

[11] Patent Number: 6,082,644

[45] Date of Patent: Jul. 4, 2000

[54] SHREDDER

[75] Inventor: Anthony Leonard Turner, Warwickshire, United Kingdom

[73] Assignee: Turner Developments, Ltd., United Kingdom

[21] Appl. No.: 09/136,025

[22] Filed: Aug. 18, 1998

[30] Foreign Application Priority Data

Aug. 19, 1997 [GB] United Kingdom ..... 9717452

[51] Int. Cl.[7] ..... B02C 18/14

[52] U.S. Cl. ..... 241/56; 241/73; 241/260; 241/295

[58] Field of Search ..... 241/101.71, 73, 241/260, 294, 295, 56; 144/208.7, 208.8, 291, 235.6

[56] References Cited

U.S. PATENT DOCUMENTS

| | | | |
|---|---|---|---|
| 2,733,742 | 2/1956 | Bedard | 144/208 |
| 2,985,206 | 5/1961 | Letts | 144/208 |
| 3,708,129 | 1/1973 | Nowak | 241/189 |
| 4,046,497 | 9/1977 | Newman, Jr. | 425/313 |
| 4,463,907 | 8/1984 | Biersack | 241/92 |
| 4,544,104 | 10/1985 | Carlsson | 241/57 |
| 5,165,611 | 11/1992 | Ragnarsson | 241/88.4 |
| 5,168,907 | 12/1992 | Herrington et al. | 144/228 |
| 5,236,139 | 8/1993 | Radtke | 241/236 |
| 5,358,189 | 10/1994 | Vandermolen | 241/92 |
| 5,379,951 | 1/1995 | Hughes | 241/60 |
| 5,390,865 | 2/1995 | Vandermolen et al. | 241/101.7 |
| 5,673,861 | 10/1997 | Miller | 241/69 |
| 5,676,321 | 10/1997 | Kroger | 241/236 |

FOREIGN PATENT DOCUMENTS 0 824 965 2/1998 European Pat. Off. .

*Primary Examiner*—Mark Rosenbaum
*Attorney, Agent, or Firm*—Chernoff, Vilhauer, McClung & Stenzel, LLP

[57] ABSTRACT

A shredder for brushwood and the like (FIG. 1) has at least one shaft carrying a helically arranged array of cutting discs surrounding the shaft. The discs are individually fixed on lugs which are generally radial to the shaft. As the brushwood is fed along generally parallel to the shaft axis it is impacted by the cutter discs, acting against one another where two parallel shafts are employed, or between the discs and a surrounding chamber wall if only a single shaft is employed. The shredded material is further fed and exhausted through a delivery passage by a current of air induced both by the discs and also by fan vanes carried by the shaft. The advantage of the discs as cutters is that if and when worn or blunted, each can be adjusted angularly on its lug to present a fresh portion of its periphery for action, without it being necessary to immediately replace or re-sharpen it.

11 Claims, 3 Drawing Sheets

SHREDDER

BACKGROUND OF THE INVENTION

This invention relates to the treatment of waste material from silviculture and like operations. It is conventional to draw a distinction in such treatment between chipping and shredding.

Generally speaking a chipper comprises a series radially extending blades mounted on a fly-wheel, and brushwood is fed in a direction generally normal to the plane of the rotating fly-wheel and cut into a series of discrete pieces. Because of the fibrous nature of the wood, larger diameter branches tend to split into a number of chips per cut, but smaller branches form a single chip from each cut.

However, chippers have limitations. Particularly thin and pliant material may not shear satisfactorily. Material with a substantial foreign body content is also unsuitable to be chipped. For example, if a sapling is up-rooted and chipped, and if the roots carry soil and stones, the stones may damage the cutter blades. As a generalisation it may be said that material which is either too soft or too hard is unsuitable for chipping.

Moreover, there is a requirement for material to be shredded finely so as to be compostable and hence recycled into the soil more quickly than is possible with mere chipped wood. This possibility is applicable even to material which is capable of being chipped satisfactorily.

Existing shredder machines commonly operate on a flail principle. That is to say, individual flail cutters are freely pivoted to a drive shaft which requires to be rotated at a substantial speed to cause the cutters to fly out centrifugally to the operating position and the waste material is then fed into their path. As a consequence of the speed and mass, the power requirement is high and frequently the noise level from an operating shredder is also high.

BRIEF SUMMARY OF THE INVENTION

The object of the present invention is to provide an improved shredder.

According to the invention a shredder comprises a plurality of cutters positioned at regular intervals along a helical path distributed around a drive shaft, and each cutter comprising a disk which is fixed in position.

A single shaft and set of cutters may be provided in a housing and material may be fed in generally tangentially of the shaft to pass between a wall of the housing and the cutters.

Alternatively, two or more shafts may be provided and material may be fed between them.

Either way, only a minor portion of the periphery of each cutter disk will be in a position for use, and in the event of damage or wear, individual disks may be adjusted about their axes so as to bring a fresh length of the periphery into use.

In general, with commercially operated shredders it is known that flail blade repair and replacement is necessary at regular intervals and with the invention, the time taken to adjust and ready the machine for further use is likely to be considerably shortened.

The helical arrangement of the cutter disks may effectively provide the equivalent of a archimedean screw to feed the material through the housing from an inlet to an exhaust and because the archimedean screw consists of a series of discrete spaced elements if may also create an air draft means to assist in material flow and to impel the shredded material through the outlet.

In one possibility, without limitation, a fly-wheel is provided for the cutter shaft and the fly-wheel is provided with radially extending reinforcing webs which also form "fan blades" to create a centrifugal flow which can be direct tangentially to the outlet for material.

In one presently preferred arrangement a single shaft has four sets of cutter disks, each set having their axes lying in a common plane containing the (single) drive shaft axis, and the four planes, corresponding to the four sets, being at 90° spacing about that axis.

Each disk may be supported in a corresponding bracket or lug and the lugs in each set are equispaced along the shaft. Each set of lugs is offset in relation to the adjacent sets so as to provide the helical location, and further each lug may be located at a like and slight angle to a plane normal to the shaft axis so that each disk lies with a diameter extending along the length of the helix.

All of the disks are like and are frusto-conical with the larger diameter end of the frusto-cone located away from the corresponding lug and the smaller end adjacent the lug. Each disk may be fixed to its lug by a bolt and nut set.

Each lug may be set as to lie in a plane which is inclined at say 75° to the axis of the shaft.

In a modification, just one end lug is set in the opposite direction so as to be inclined at approximately 105° to the axis of the shaft. This is used to further reduce particle size to allow passage along the screw and effect and cause material lying generally between successive cutter blades after shredding to be ejected from the shaft towards an outlet from the machine.

A screen may be provided before the outlet to retain material within the vicinity of the cutters until the particle size is reduced below the screen aperture size.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
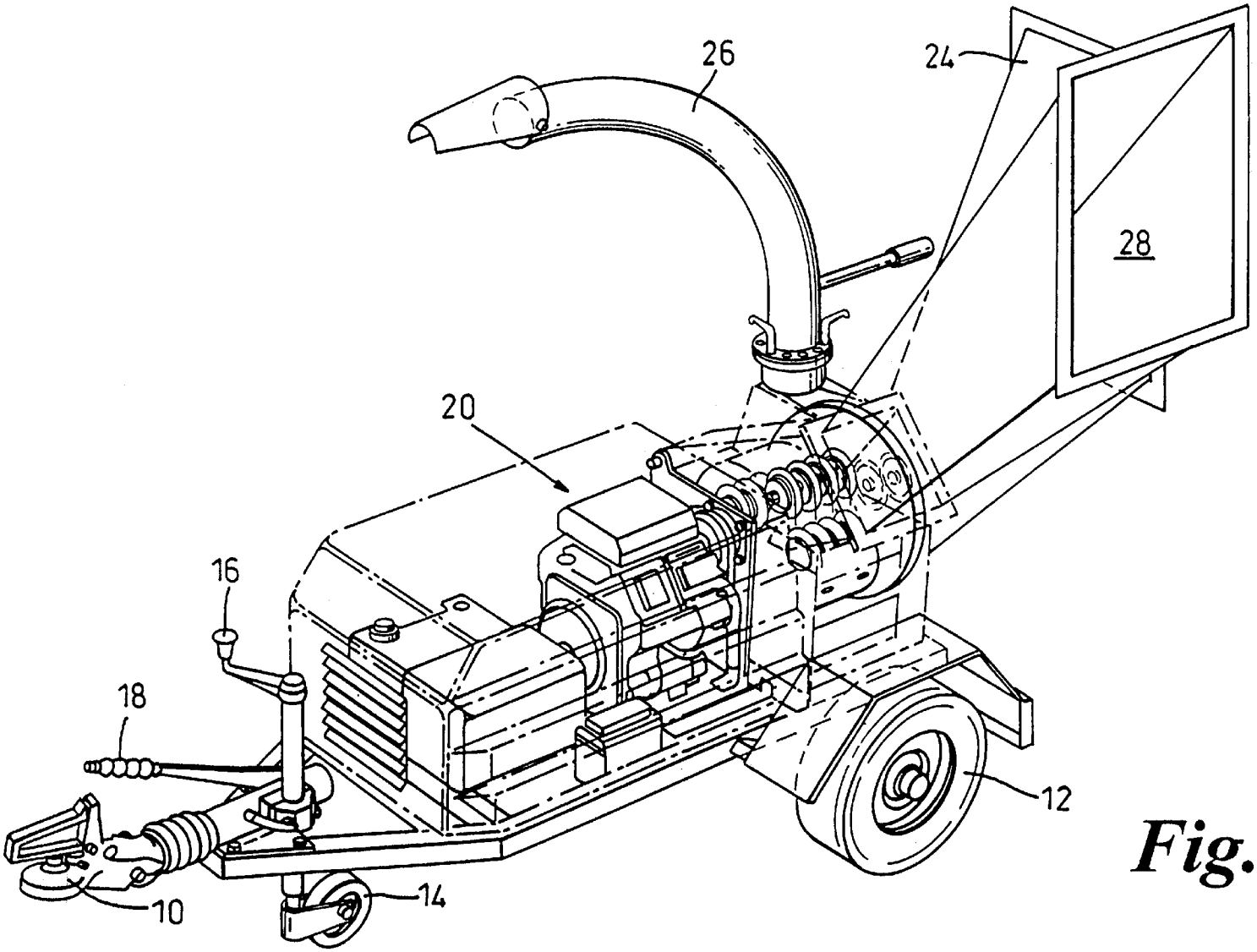
FIG. 1 is a diagrammatic perspective view of a combined shredding and chipping machine.

Turning first to FIG. 1, the machine is constructed as a trailer intended to be towed behind a vehicle to an intended place of use. To this end there is a conventional hitch 10, trailer wheels 12, and a jockey wheel 14 for use in manoeuvring the trailer when disconnected from the vehicle. The wheel 14 can be raised and lowered by the crank handle 16 and locked in position by the handbrake 18.

The machine comprises a drive engine 20 with associated fuel tank, coolant system, starter motor and the usual accessories. The motor drives a shaft 30 (FIGS. 2–4).

Figure 2:
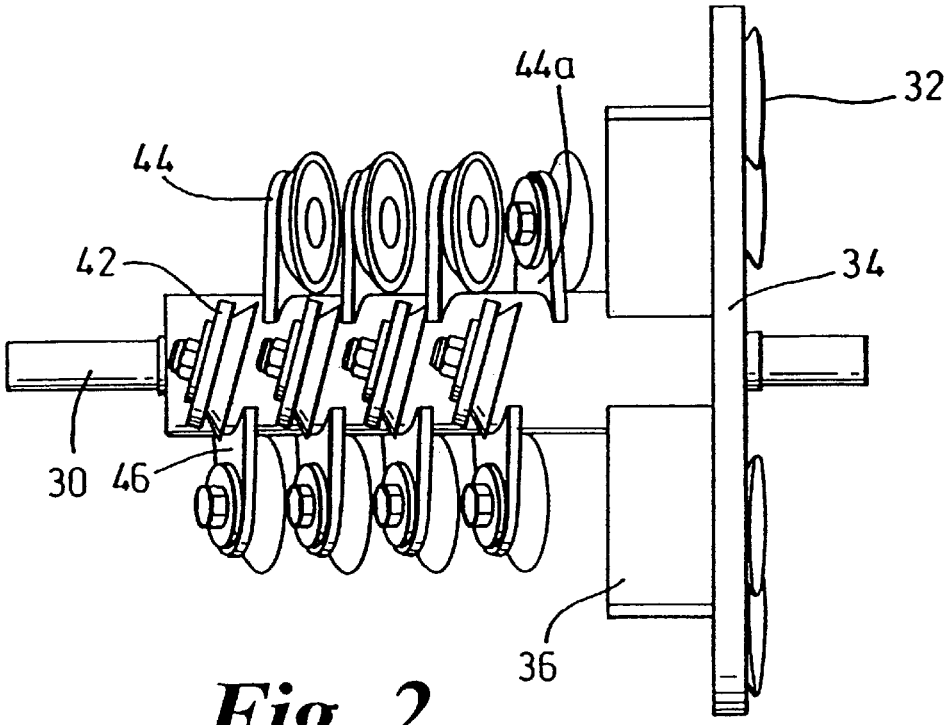
FIG. 2 is an elevation on an enlarged scale of the cutter sets of the shredding part of the machine.
Figure 3:
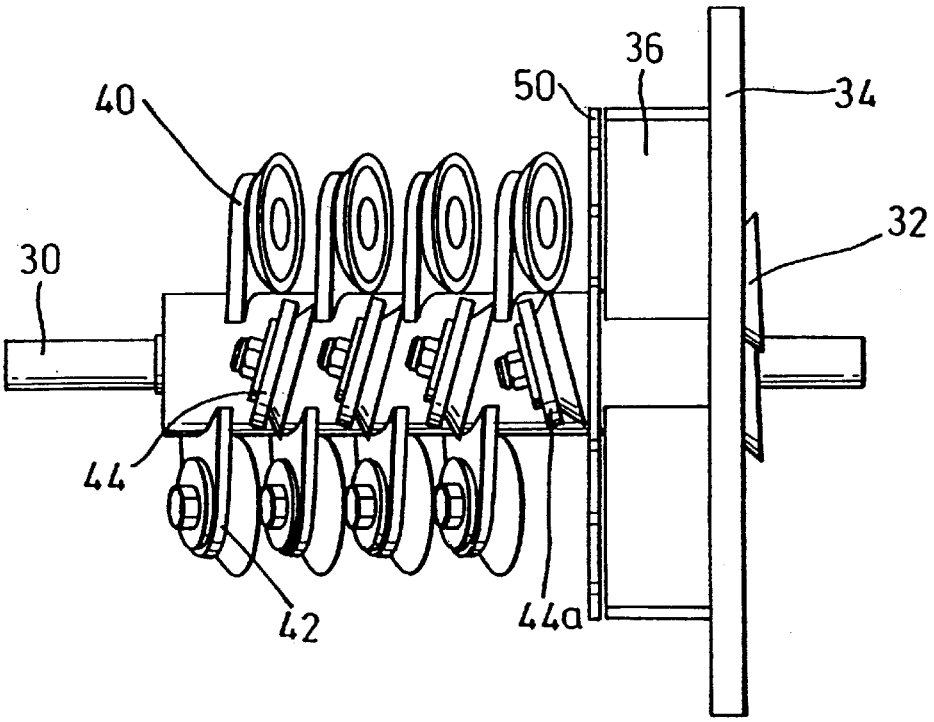
FIG. 3 is a plan view of the arrangement shown in FIG. 2.
Figure 4:
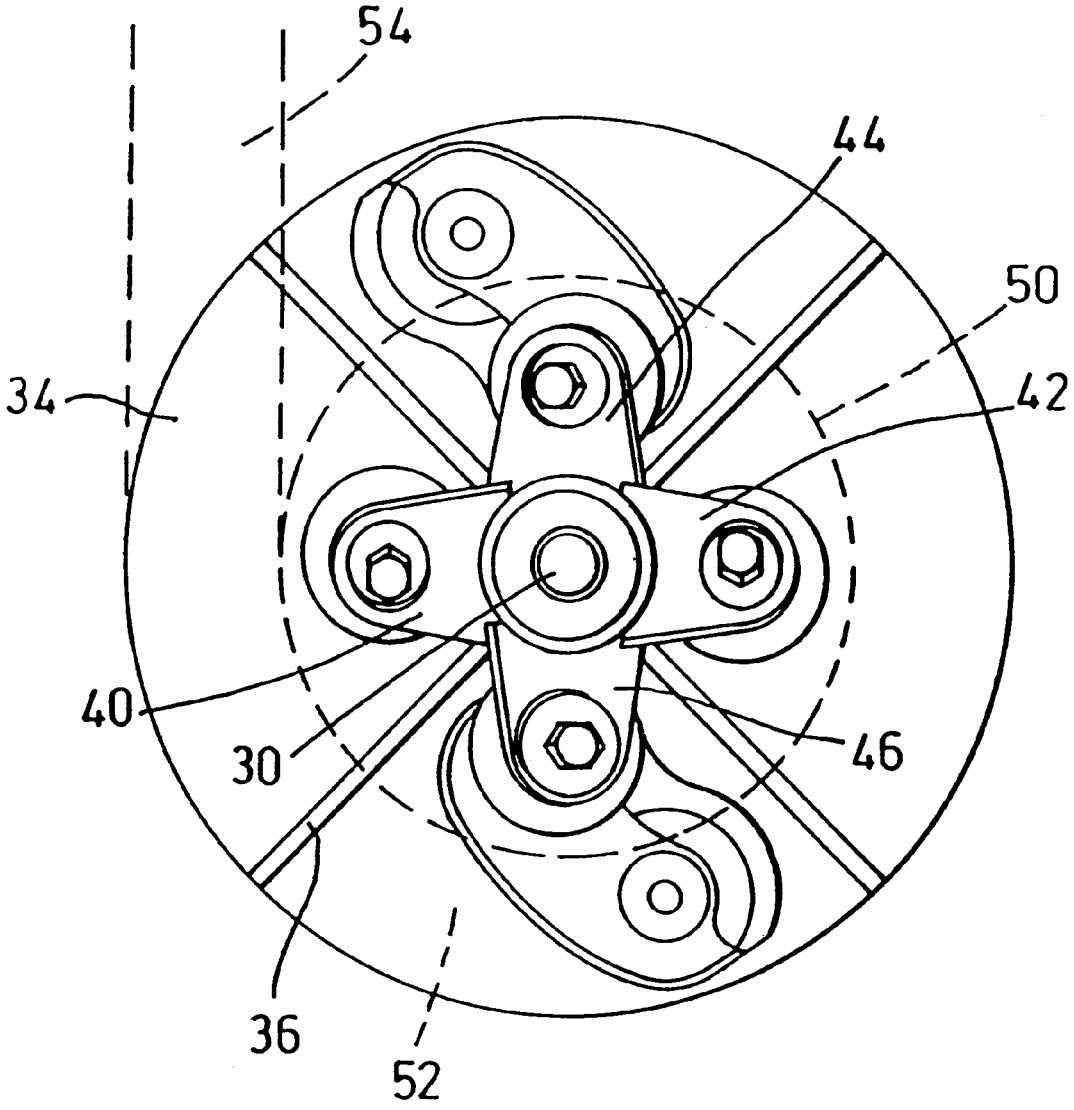
FIG. 4 is an end elevation of the arrangement shown in FIGS. 2 and 3.

The cutter systems shown in FIGS. 2–4 operate within a housing having a pair of inlets 24, 28 and a common outlet 26 which can be swivelled to be directed in any required direction.

The input hopper 24 delivers to a chipper comprising cutters 32 located on one side of fly-wheel disk 34, but the chipper forms no part of the present invention and is not further described herein.

On the opposite side of the fly-wheel disk 34 are vanes 36 which serve both to reinforce the fly-wheel disk 34 and also to assist an air current to draw material through the machine and eject it through the outlet 26.

The shredder system comprises four sets of lugs 40, 42, 44, 46 each set being generally aligned so that bores, to receive mounting bolts, have a common axis and that axis lies in a plane also containing the axis of shaft 30. The four planes are at right-angles to one another.

Each lug is twisted out of a plane normal to the axis of the shaft 30 to an angle of, in this instance, 75°. This is true for all of the lugs except the lug 44*a* which is twisted in the opposite direction so as to be at an angle of 105° to the shaft axis.

It will be appreciated in the machine described that there is only a single cutter shaft carrying the four sets of cutters and in this case material is fed into the hopper 28 to fall by gravity or to be pushed into a chamber which closely surrounds the cutters for example as indicated by the broken line 50, FIG. 4, when it will be fed around and along the shaft being shredded in the process.

A screen plate 50, shown in FIG. 3 but omitted from FIG. 2 for clarity, is provided at the outlet from the chamber, having a set of apertures of a suitable size. The screens may be interchangeable to allow the degree of shredding undergone by the material to be controlled. The screen plate is substantially the same diameter as the chamber 50 whereas the vanes 36 run in an enlarged diameter chamber having a tangential outlet 54 leading to the exhaust or delivery pipe 26.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A shredder for brushwood comprising:

(a) a drive shaft;

(b) a plurality of independently mounted disc shaped cutters positioned at regular intervals along a helical path distributed around said drive shaft, each cutter being fixed in position relative to said drive shaft; and (c) a waste outlet arranged adjacent to an end of said drive shaft, whereby said distribution of said cutters along said helical path effects movement of shredded brushwood generally axially of said drive shaft towards said waste outlet.

2. A shredder as claimed in claim 1 wherein each cutter comprises a disc having a sharpened periphery, and mounted on a corresponding lug extending generally radially of the shaft, together with means for fixing the cutter angularly in a position for use and permitting of angular adjustment when so required.

3. A shredder as claimed in claim 2 wherein each lug lies at a like angle to a plane normal to the axis of the shaft.

4. A shredder as claimed in claim 2 wherein each disc is frusto-conical.

5. A shredder as claimed in claim 2 wherein all of the lugs except for one extreme end lug all lie at a like angle to a series of parallel planes normal to the shaft axis, and said extreme end lug lies at an equal but opposite angle to a plane normal to said shaft axis.

6. A shredder for brushwood comprising:

(a) a drive shaft;

(b) a plurality of independently mounted disc shaped cutters positioned at regular intervals along a helical path distributed around said drive shaft, each cutter being fixed in position relative to said drive shaft; and (c) a screen adjacent the delivery end of said helical path to permit material shredded below predetermined dimensions to pass through said screen, and retain material in excess of said dimension for further shredding action.

7. A shredder for brushwood comprising:

(a) a drive shaft disposed in a chamber; and (b) a plurality of independently mounted disc shaped cutters positioned at regular intervals along a helical path distributed around said drive shaft, each cutter being fixed in position relative to said drive shaft so that shredding is effected by impaction between a wall of the chamber and the cutters.

8. A shredder for brushwood comprising:

(a) a drive shaft;

(b) a plurality of independently mounted disc shaped cutters positioned at regular intervals along a helical path distributed around said drive shaft, each cutter being fixed in position relative to said drive shaft; and (c) a flywheel with generally radially extending webs or vanes carried by said drive shaft and disposed in a chamber located at the delivery end of the cutter set, and arranged to provide air flow to exhaust tangentially from said chamber carrying the shredded material.

9. A shredder as claimed in claim 8 wherein said flywheel has a plurality of chipper cutters positioned thereon.

10. A shredder for brushwood comprising:

(a) a drive shaft having a first end and a second end, a flywheel positioned perpendicular to said drive shaft at said first end of said drive shaft;

(b) a plurality of cutters positioned at regular intervals along a helical path distributed around said drive shaft between said flywheel and said second end, each cutter comprising a disc which is fixed in position relative to said shaft; and (c) said flywheel having generally radially extending webs or vanes between said flywheel and said cutters, said webs or vanes arranged to provide an air flow.

11. A combination shredder and chipper comprising:

(a) a drive shaft having a first end and a second end, a flywheel positioned perpendicular to said drive shaft at said first end of said drive shaft;

(b) a plurality of cutters positioned at regular intervals along a helical path distributed around said drive shaft between said flywheel and said second end, each cutter comprising a disc which is fixed in position relative to said shaft;

(c) said flywheel having generally radially extending webs or vanes between said flywheel and said cutters, said webs or vanes arranged to provide an air flow; and (d) said flywheel having a plurality of chipper cutters positioned thereon between said flywheel and said first end.

* * * * *